United States Patent [19]

Kaulig

[11] 4,155,727

[45] May 22, 1979

[54] VACUUM CLEANER BAG

[75] Inventor: Heinz Kaulig, Wuppertal, Fed. Rep. of Germany

[73] Assignee: Vorwerk & Co. Interholding GmbH, Wuppertal, Fed. Rep. of Germany

[21] Appl. No.: 829,983

[22] Filed: Sep. 1, 1977

[30] Foreign Application Priority Data

Sep. 7, 1976 [DE] Fed. Rep. of Germany ... 76 7891[U]

[51] Int. Cl.[2] ..... B01D 46/02

[52] U.S. Cl. ..... 55/381; 55/DIG. 2; 206/466; 229/53

[58] Field of Search ..... 55/381, 382, 505, DIG. 2, 55/361, DIG. 3, 367; 206/466; 229/53, 14 B, 14 BE; 220/65, 63 R; 93/35 VL; 15/327 E, DIG. 8; 285/27; 150/DIG. 1

[56] References Cited

U.S. PATENT DOCUMENTS

| | | | |
|---|---|---|---|
| 2,324,231 | 7/1943 | Österdahl | 55/382 |
| 2,909,238 | 10/1959 | Lofgren | 55/382 |

FOREIGN PATENT DOCUMENTS

| | | | |
|---|---|---|---|
| 567484 | 2/1945 | United Kingdom | 55/381 |

*Primary Examiner*—Frank W. Lutter
*Assistant Examiner*—David L. Lacey
*Attorney, Agent, or Firm*—Michael J. Striker

[57] ABSTRACT

A disposable vacuum cleaner bag of paper is insertable into a bag compartment of a cleaner. It has an open dirt intake end and a remote closed end. At the closed end the bag is provided with one or more reinforcing strips having bevelled edges.

5 Claims, 2 Drawing Figures

VACUUM CLEANER BAG

BACKGROUND OF THE INVENTION

This invention relates to vacuum cleaners in general. In particular, the invention relates to a disposable vacuum cleaner bag.

Most modern vacuum cleaners use disposable (usually paper) dirt bags which are generally installed in a special compartment provided for this purpose in the vacuum cleaner. Some of these compartments are not readily accessible; also, they are sometimes reinforced by internal reinforcing ribs that usually extend transversely to the direction in which the bag is inserted and removed.

Under these circumstances it is difficult to properly insert the bag, since such bags are not shape-retaining and, on insertion into the compartment, tend to become snagged on the ribs. If the bag is not properly inserted, however, then it cannot fully unfold when air (and dirt) enter into it; this, in turn, means that the bag cannot become filled with dirt to capacity so that it must be discarded when it is only partly filled. In many instances there is insufficient room for the user to insert a hand into the compartment to straighten the bag out, i.e. to properly position it in the compartment. Even if there is adequate space for this, such an insertion is impossible if the bag is provided with a stiffening plate as is the case in most of these bags.

SUMMARY OF THE INVENTION

It is, therefore, an object of the invention to provide an improved vacuum cleaner bag which avoids the aforementioned disadvantages.

Another object is to provide such a bag which will not become snagged on compartment reinforcing ribs during its insertion into the bag compartment of a vacuum cleaner.

In keeping with these objects and with others which will become apparent hereafter, one feature of the invention resides in a disposable vacuum cleaner bag for installation in vacuum cleaner bag compartments having internal projections which comprises an elongated bag body having an open end and a closed end which latter is inserted first when the bag is to be installed in a vacuum cleaner bag compartment; and anti-snag means on the bag body at least at the closed end to prevent snagging of the bag body on the internal projections of the bag compartment during insertion of the bag into the same.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
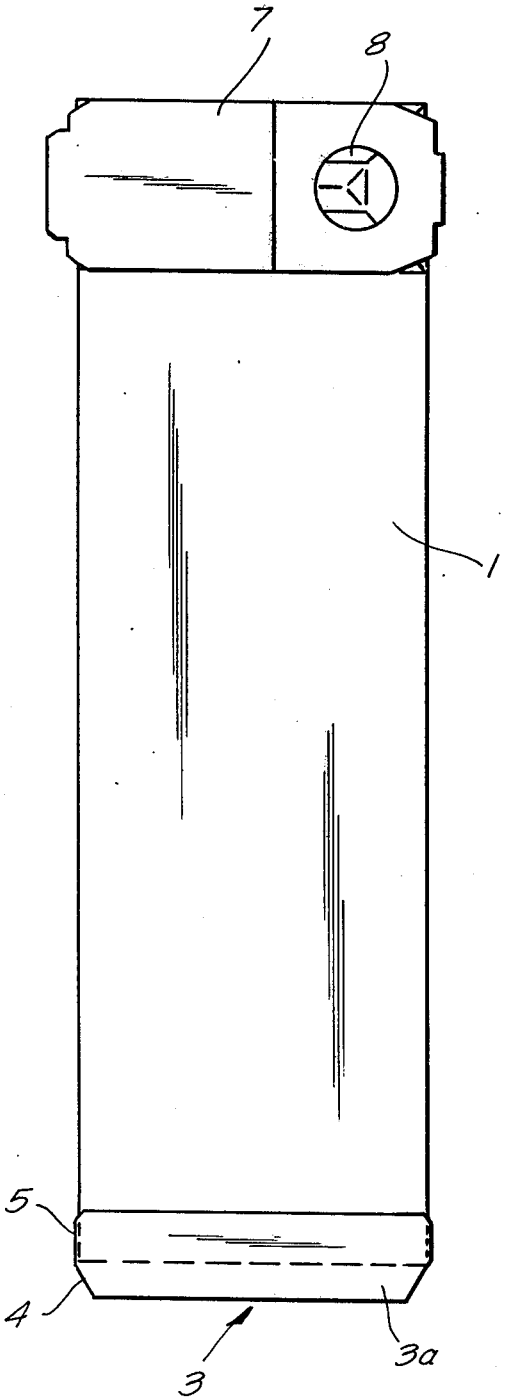
FIG. 1 is a plan view of a vacuum cleaner bag according to the invention.
Figure 2:
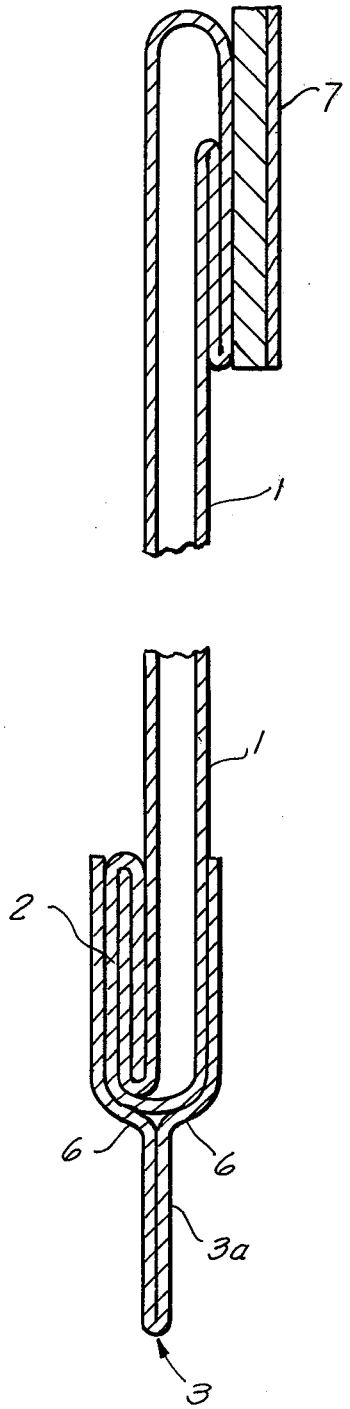
FIG. 2 is a side view of the bag in FIG. 1, seen from the left side of that Figure.

A novel vacuum cleaner bag 1 according to the invention is shown in FIGS. 1 and 2. It is of the disposable type and usually made of paper. The bag 1 is provided with a mounting (arresting) plate 7 by means of which it is secured in operative position in the bag compartment of a vacuum cleaner (not shown). Plate 7 is provided with an opening 8 which communicates with the interior of the bag 1 and through which air and entrained dirt enter the bag from the vacuum cleaner intake.

The distal end 2 of the bag 1, i.e. the one remote from plate 7, is closed and provided, according to the invention, with a reinforcing strip 3. As plainly shown in FIG. 2, the strip 3 is composed of two symmetrical portions 6 which are folded to the angled shaped shown in FIG. 2 (to become mirror-symmetrical) and secured to the bag 1, e.g. by means of a suitable adhesive, to sandwich the closed end 2 between them.

The transverse edges 4 of that part 3*a* of strip 3 which projects beyond the bag 1 in longitudinal direction of the same, are bevelled or inclined in this longitudinal direction. The transverse width of the strip 3 is slightly greater than the transverse width of the bag 1, as indicated by reference numeral 5.

When a bag 1 provided with the strip 3 is inserted into a bag compartment of a vacuum cleaner, with the end 2 as the leading end, the inclination of the edges 4 assures that the bag cannot become snagged on internal reinforcing ribs or other internal projections of the compartment, since they serve as deflectors which will slide over such projections. This effect is aided and enhanced by the fact that the bag 1 itself has a lesser width than the strip 3, as shown at 5. The bag will therefore be able to enter over its full length in unfolded and unkinked condition into the compartment, so that in operation of the vacuum cleaner it can unfold over its entire length and receive the maximum amount of dirt.

The invention is susceptible of various modifications without departing from its spirit and intent. For example, two or more strips 3 could be provided on the bag, in the region of the closed end thereof. The strip or strips 3 could have a construction different from the illustrated one, i.e. it need not be of the two illustrated sections 6 but could be of one piece and appropriately folded. Also, the bevelled edges 4 by themselves already offer a substantial advantage; the lateral overhang designated by reference numeral 5 could therefore be omitted although it is considered advantageous since it further enhances the anti-snag effect.

While the invention has been illustrated and described as embodied in a vacuum cleaner bag, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A disposable vacuum cleaner bag for installation in vacuum cleaner bag compartments having internal projections, comprising an elongated bag body composed at least in part of air-permeable but dust-filtering material and having an open end and a closed end which latter is inserted first when the bag is to be installed in said vacuum cleaner bag compartment; and anti-snag means on said bag body at least at said closed end to prevent snagging of the bag body on the internal projections of the bag compartment during insertion of the bag into the same.

2. A disposable vacuum cleaner bag as defined in claim 1, wherein said anti-snag means comprise at least one reinforcing strip mounted on said bag body, extending transversely thereof and having lateral edge portions which converge towards one another and in direction away from said open end.

3. A disposable vacuum cleaner bag as defined in claim 2, wherein said at least one strip extends beyond the respective lateral edges of said bag body.

4. A disposable vacuum cleaner bag as defined in claim 2, wherein said at least one strip is composed of two symmetrical strip sections each connected to the other and sandwiching said closed end between themselves.

5. A disposable vacuum cleaner bag as defined in claim 4, each of said strip sections having one portion overlying a part of said bag body and another portion projecting beyond said closed end, said other portions overlying one another and being provided with said lateral edge portions.

* * * * *